US006497015B1

(12) United States Patent
Kato et al.

(10) Patent No.: US 6,497,015 B1
(45) Date of Patent: Dec. 24, 2002

(54) LINEAR SLIDE FASTENER

(75) Inventors: Takashi Kato; Yoshihiro Kousaka; Shigeru Imai, all of Toyama-ken (JP)

(73) Assignee: YKK Corporation, Tokyo (JP)

( * ) Notice: Subject to any disclaimer, the term of this patent is extended or adjusted under 35 U.S.C. 154(b) by 359 days.

(21) Appl. No.: 09/625,430

(22) Filed: Jul. 25, 2000

(30) Foreign Application Priority Data

Jul. 30, 1999 (JP) ..... 11-216653

(51) Int. Cl.[7] ..... A44B 19/10

(52) U.S. Cl. ..... 24/394; 24/401; 24/402; 24/396

(58) Field of Search ..... 24/391, 394, 395, 24/396, 401, 402, 407, 408

(56) References Cited

U.S. PATENT DOCUMENTS

| | | | | | |
|---|---|---|---|---|---|
| 3,149,388 | A | * | 9/1964 | Wilcken | 24/396 |
| 3,789,465 | A | * | 2/1974 | Moertel | 24/395 |
| 3,812,555 | A | | 5/1974 | Yoshida | |
| 3,836,413 | A | | 9/1974 | Frohlich et al. | |
| 3,855,671 | A | | 12/1974 | Fujisaki | |
| 3,925,859 | A | | 12/1975 | Yoshikawa | |
| 3,975,801 | A | * | 8/1976 | Moertel | 24/394 |
| 4,034,444 | A | * | 7/1977 | Moertel | 24/394 |
| 4,047,265 | A | * | 9/1977 | Matsuda | 24/413 |
| 4,205,027 | A | | 5/1980 | Heimberger | |
| 4,319,387 | A | * | 3/1982 | Yoshida | 24/394 |
| 4,623,004 | A | * | 11/1986 | Matsushima et al. | 24/392 X |
| 4,639,981 | A | * | 2/1987 | Yoshida et al. | 24/401 |
| 5,129,127 | A | * | 7/1992 | Hamatani | 24/394 |

FOREIGN PATENT DOCUMENTS

| | | |
|---|---|---|
| BE | 785 042 A | 10/1972 |
| FR | 2 145 365 | 2/1973 |
| JP | 54-20895 | 7/1979 |

OTHER PUBLICATIONS

European Search Report of Corresponding application EP00115863.

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

A coil-shaped fastener element is comprised of a coupling head bulging to both sides, upper/lower leg portions adjacent the coupling head and a connecting portion for connecting the upper and lower leg portions. With providing a stepped portion in a center of the upper leg portion, a portion of the fastener element on a side of the coupling head is formed thick while a portion thereof on a side of the connecting portion is formed thin. A coupling space is provided between the upper and lower leg portions. A protruded portion protruded into the coupling space is provided in a back of the stepped portion of the upper leg portion. A slope portion is formed such that the coupling space is expanded from an inside of an upper portion of the coupling head to a base portion of the protruded portion. A core thread is inserted between the upper and lower leg portions and sewed using a sewing yarn of multi-thread chain stitches as fixing yarn, such that a side edge of the core thread is protruded toward the coupling head. Upon coupling, the coupling head is allowed to be inserted quickly along the slope portion and an excessive insertion of a mating coupling element is prevented by the protruded portion and core thread so as to stabilize the coupling. Thus, the linear slide fastener enables a smooth and quick coupling operation.

9 Claims, 10 Drawing Sheets

LINEAR SLIDE FASTENER

BACKGROUND OF THE INVENTION

1. Field of the Invention

The present invention relates to a linear slide fastener, wherein coil-shaped or zigzag-shaped fastener elements of a particular shape are formed with monofilament of thermoplastic resin and the fastener elements are attached to a side edge of a fastener tape with fixing yarn of various type.

2. Description of the Related Art

According to a coil-shaped slide fastener as disclosed in Japanese Patent Publication No. 49-23874, as shown in FIG. 14, by providing a stepped portion 8' in an upper leg portion 5' of each of the fastener elements 2', a portion of the fastener element 2' on a side of a coupling head is formed to be thick while a portion on the side of a connecting portion 7' is formed to be thin. A core thread 28' is inserted between the upper leg portion 5' and a lower leg portion 6' on the side of the connecting portion 7' that are formed to be thin, and sewed to the side edge of the fastener tape 13'. Then, a horn is lowered to apply pressure to the leg portions 5' 6' and connecting portions 7' of the fastener elements 2' around the core thread 28'. Then, while the fastener elements 2' are heated, the fastener elements 2', sewing yarn 15' and fastener tape 13' are fused together by ultrasonic processing.

According to coil-shaped fastener elements as disclosed in Japanese Patent Publication No. 54-20895, with providing a stepped portion 8" in an upper leg portion 5" of each of the fastener elements 2", a portion of the fastener element 2" on a side of the coupling head 4" is formed to be thick, while a portion thereof on a side of the connecting portion 7" is formed to be thin. Then, the thin leg portion on the side of the connecting portion 7" is sewed to a side edge of the fastener tape 13" with sewing yarn 15".

In the coil-shaped slide fastener shown in FIG. 14 and as described above, the coil-shaped fastener elements 2' are disposed in such a state that each of the upper leg portions 5' is parallel to each of the corresponding lower leg portions 6' at a section from the corresponding coupling head 4' to the stepped portion 8' in a center thereof. Thus, a mating coupling head 4' cannot be inserted smoothly at the time of coupling operation. Therefore, a sliding action of the slider becomes heavy so that it cannot be operated smoothly. Further, because the core thread 28' inserted through the fastener elements 2' is fused at a section from the stepped portion formed thin to the connecting portion 7', a coupling head 4' does not make an elastic contact with the mating coupling head 4' at the time of coupling. Therefore, an cushion effect can not be expected, thus a smooth coupling can not be achieved.

In the coil-shaped slide fastener shown in FIG. 15, like the above described example, the fastener elements 2" are disposed in such a state that each of the upper leg portions 5" is parallel to each of the corresponding lower leg portions 6" at a section from the coupling head 4" to the stepped portion 8" in a center thereof. Thus, a mating coupling head cannot be inserted smoothly at the time of coupling operation. Thus, a sliding operation of the slider becomes heavy, so that it cannot be operated smoothly. Further, because no core thread exists, the fastener elements 2" are likely to be loose.

SUMMARY OF THE INVENTION

Accordingly, the present invention has been achieved in views of the above problems. Therefore, a main object of the present invention is to provide a linear slide fastener, wherein upon coupling operation, a coupling head of each of linear fastener elements in the slide fastener can be inserted into a coupling space of a mating coupling head quickly so that the coupling operation of the fastener elements can be carried out smoothly, thereby enabling to operate the slide fastener lightly, preventing an excessive invasion of the coupling head, and preventing a fixing yarn for fixing the fastener elements from being worn by a sliding of the slider, so as to ensure a long term use thereof.

Further, an object of the present invention is to provide a linear slide fastener, wherein the fastener elements are fixed firmly by specifying a use state of the fixing yarn for fixing the linear fastener elements onto a fastener tape and by applying the fixing yarn to various types of slide fasteners.

Furthermore, an object of the present invention is to provide a linear slide fastener, wherein different types of linear slide fasteners with beautiful appearance can be obtained by specifying configurations of the linear fastener elements in the linear slide fasteners.

Still further, an object of the present invention is to provide a linear slide fastener, wherein even if a pushing force is applied to the linear fastener elements in a coupling state, the coupling state is prevented from being broken by the core thread inserted through the linear fastener elements and the core thread can act as a cushion when the coupling heads couple each other so as to ensure a smooth and flexible sliding operation.

Still further, an object of the present invention is to provide a linear slide fastener, wherein the core thread inserted through the linear fastener elements in the coupling space is always protruded in an advantageous state so as to maintain a cushion state.

Still further, an object of the present invention is to provide a linear slide fastener, wherein fixing yarn disposed between the linear fastener elements can act as a cushion when the coupling heads couple each other so as to ensure a flexible and smooth sliding operation of the slider.

To achieve the above objects, according to the present invention, there is provided a linear slide fastener, wherein various kinds of linear fastener elements are formed of thermoplastic resin monofilament; with providing a stepped portion in a center of an upper leg portion of each of the linear fastener elements, a portion of the fastener element on a side of a coupling head is formed to be thick while a portion thereof on a side of a connecting portion is formed to be thin; a protruded portion protruded into a coupling space between the upper leg portion and the lower leg portion is provided on an inner face of the upper leg portion; a slope portion is formed such that the coupling space between the upper leg portion and the lower leg portion is expanded gradually from an inside of an upper portion of the coupling head to a base portion of the protruded portion; and the fastener elements are fixed to a fastener tape at the upper leg portion and the lower leg portion at the connecting portion side that are formed thin with fixing yarn.

Further, according to the present invention, there is provided a linear slide fastener, wherein the linear fastener elements are sewed on a surface of a side edge of the fastener tape using a sewing yarn as the fixing yarn for fixing the linear fastener elements.

Alternatively, according to the present invention, there is provided a linear slide fastener, wherein the linear fastener elements are woven into a side edge of the fastener tape using weaving yarn as the fixing yarn for fixing the linear fastener elements.

Further alternatively, according to the present invention, there is provided a linear slide fastener, wherein the linear fastener elements are knitted into a side edge of the fastener tape using warp knitting yarn as the fixing yarn for fixing the linear fastener elements.

Further, according to the present invention, there is provided a linear slide fastener, wherein the linear fastener elements are in a form of coil-shaped fastener elements produced by winding a monofilament in a coil-shaped shape.

Alternatively, according to the present invention, there is provided a linear slide fastener, wherein the linear fastener elements are in a form of zigzag shaped fastener elements produced by bending a monofilament in a zigzag shape.

Further, according to the present invention, there is provided a linear slide fastener, wherein a side edge of a core thread inserted between the upper leg portions and lower leg portions of the linear fastener elements is protruded toward the coupling heads beyond the protruded portions.

Furthermore, according to the present invention, there is provided a linear slide fastener, wherein a needle yarn of multi-thread chain stitches urges the core thread in the linear fastener elements such that the side edge of the core thread is always protruded.

Still further, according to the present invention, there is provided a linear slide fastener, wherein a side edge of the fixing yarn disposed between adjacent ones of the linear fastener elements is protruded toward the coupling heads beyond the protruded portions.

DESCRIPTION OF THE PREFERRED EMBODIMENTS

Hereinafter, embodiments of the present invention will be described in detail with reference to the accompanying drawings.

Figure 10:
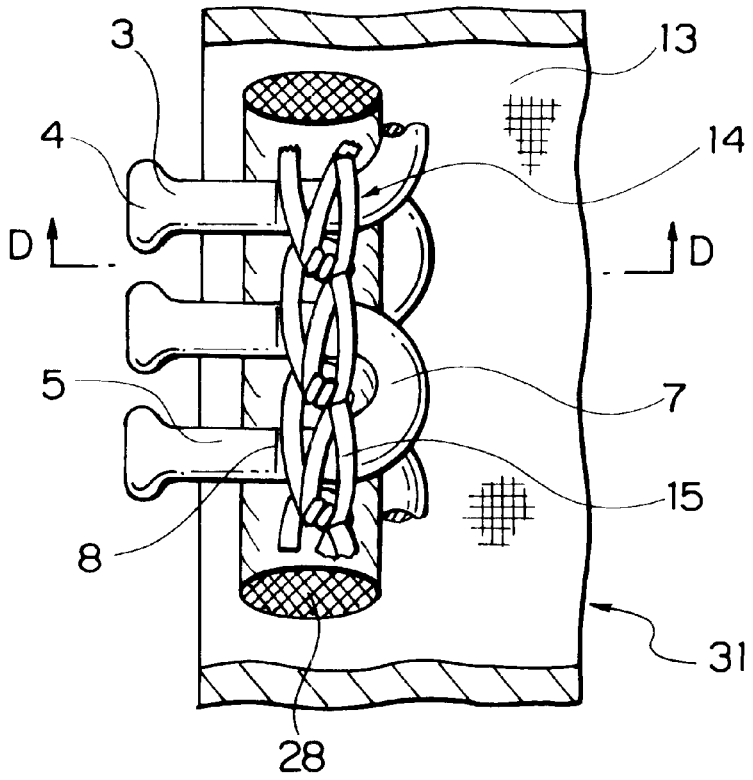
FIG. 10 is a front view of a fastener stringer in the linear slide fastener on which the zigzag fastener elements are sewed.
Figure 11:
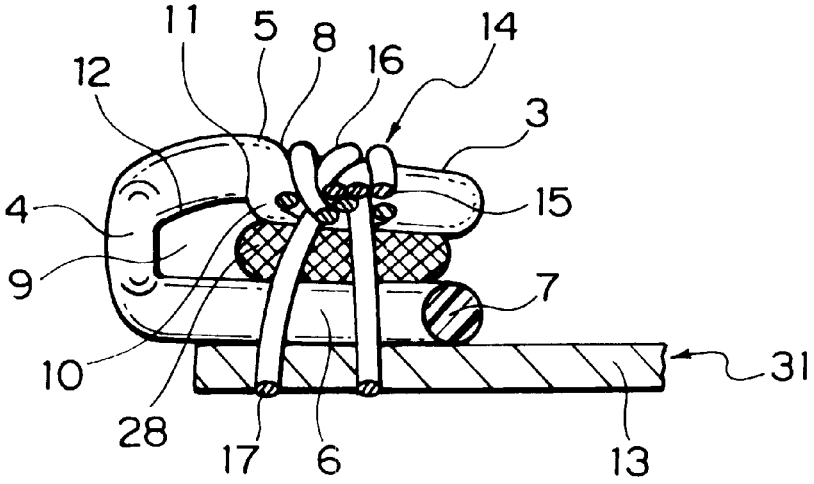
FIG. 11 is a sectional view taken along the line D—D of FIG. 10 showing the same fastener stringer.

The linear slide fastener of the present invention is produced with a coil-shaped fastener elements 2 which are formed by winding monofilament of thermoplastic resin in a coil shape as shown in FIGS. 1 to 4 or a zigzag shaped fastener elements 3 which are formed by bending monofilament of thermoplastic resin in a zigzag shape as shown in FIGS. 10 and 11. Then, the linear fastener elements are formed into the coil-shaped fastener elements 2 or zigzag shaped fastener elements 3 with monofilament of thermoplastic such as polyamide and polyester.

The linear slide fasteners using the coil-shaped fastener element 2 and zigzag fastener element 3 having a feature structure of the present invention will be described in detail.

The coil-shaped fastener element 2 of a first embodiment shown in FIGS. 1 to 4 is comprised of a coupling head 4 bulging to both sides in an arrangement direction of the respective coil-shaped fastener elements 2, upper and lower leg portions 5, 6 extending in parallel in a direction perpendicular to the aforementioned arrangement direction from a top end to a bottom end of the coupling head 4, and a connecting portion 7 for connecting the upper leg portion 5 with the lower leg portion 6 of adjacent coil-shaped fastener elements 2. Then, a portion on a side of the coupling head 4 is formed to be thick and a portion of the fastener element 2 on the side of the connecting portion 7 is formed to be thin so as to forma stepped portion 8 for providing a step in a center of a top surface of the upper leg portion 5. A coupling space 9, which is surrounded by the upper leg portion 5 and lower leg portion 6, is provided inside of the coupling head 4. Further, a protruded portion 10 protruded into the coupling space 9 is provided in a back side of the stepped portion 8 of the upper leg portion 5. Then, a slope portion 12 is formed such that the coupling space 9 increases gradually from an inside of an upper portion of the coupling head 4 to a base portion 11 of the protruded portion 10.

Figure 1:
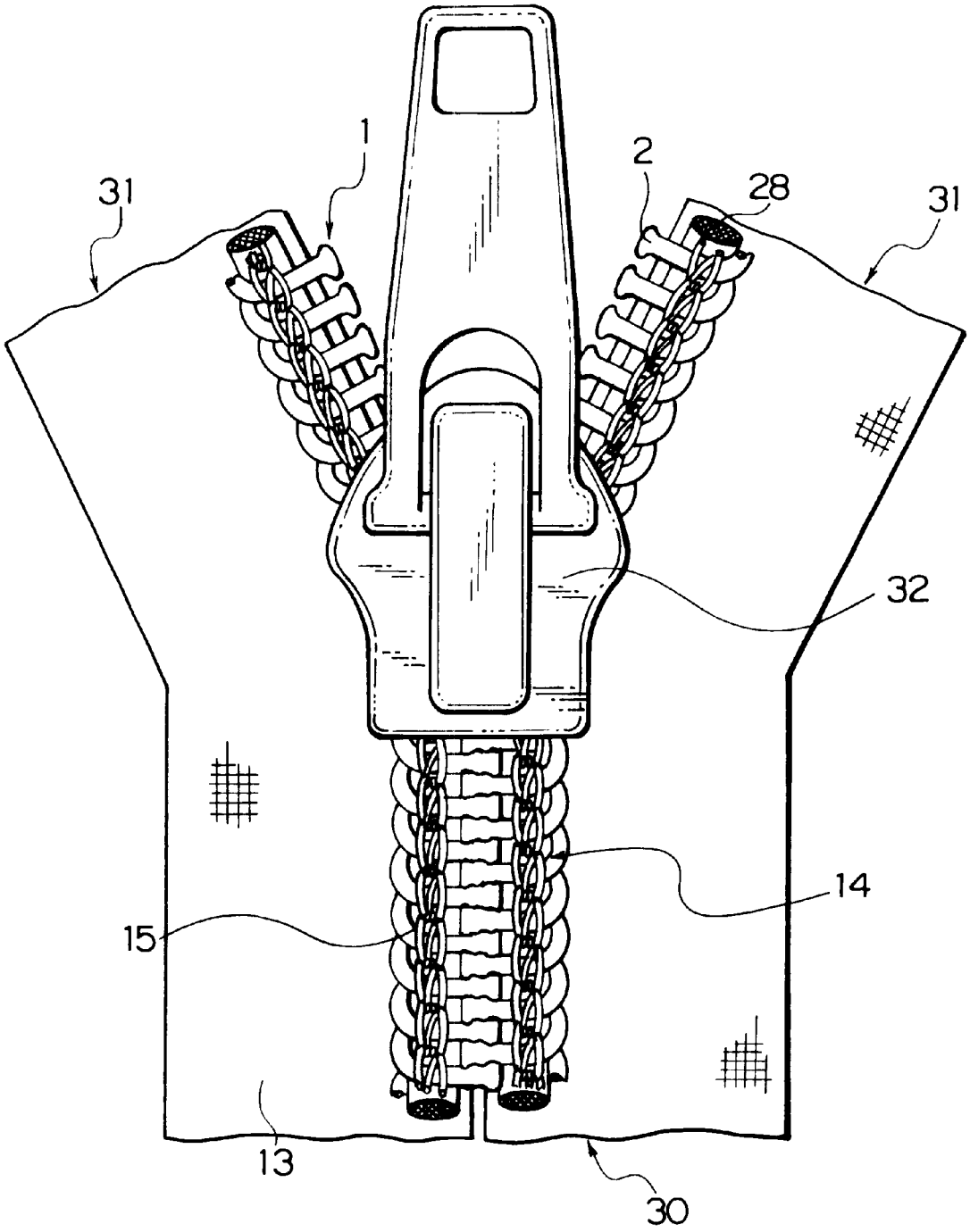
FIG. 1 is a front view of a linear slide fastener.
Figure 2:
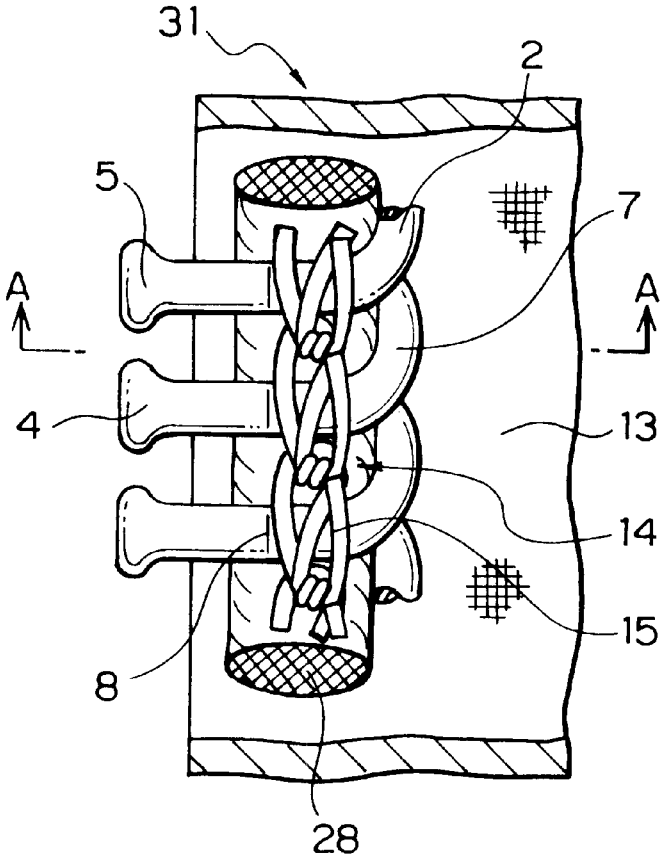
FIG. 2 is a front view of a fastener stringer using coil-shaped fastener elements in the linear slide fastener.
Figure 3:
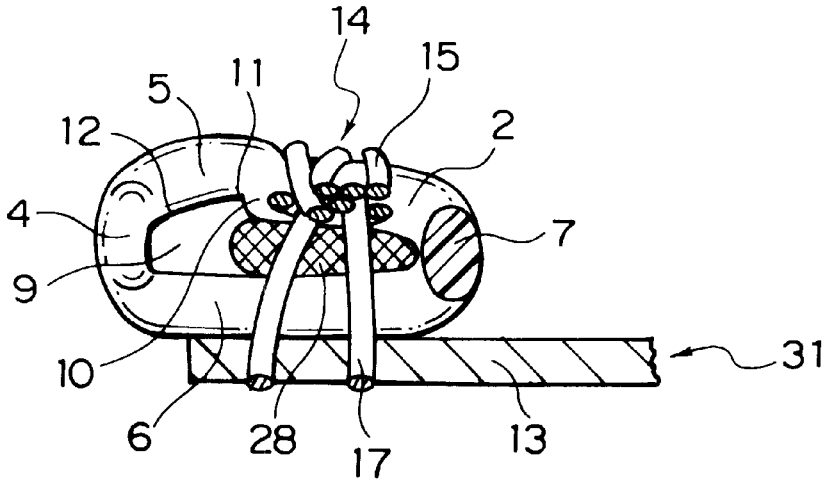
FIG. 3 is a sectional view taken along the line A—A of FIG. 2 showing the same fastener stringer.
Figure 4:
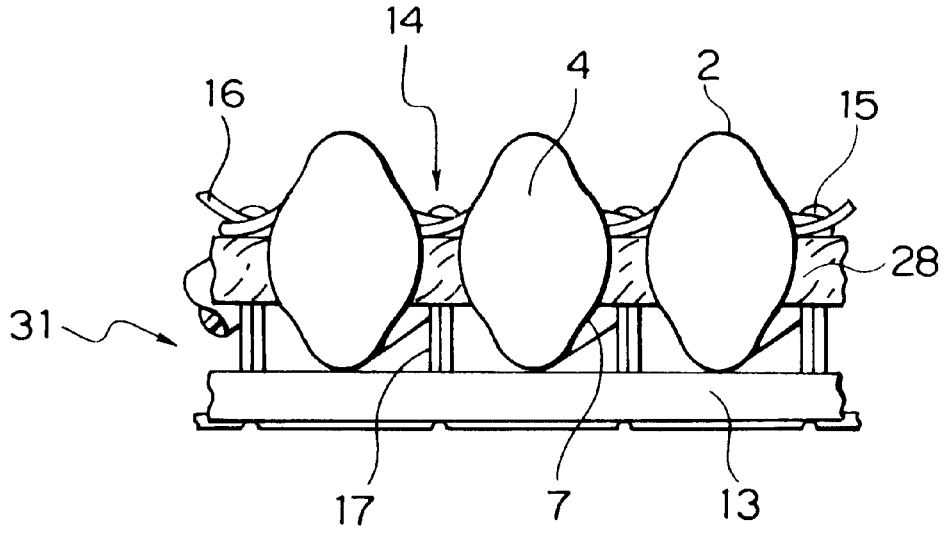
FIG. 4 is a side view in an arrow direction of FIG. 2 showing the same fastener stringer.

The coil-shaped fastener elements 2 described above are mounted on a side edge of a fastener tape 13 of the slide fastener. A core thread 28 is inserted between the upper leg portion 5 and lower leg portion 6 in a section from the stepped portion 8 provided in the upper leg portion 5 to the connecting portion 7 of the coil-shaped fastener element 2, and the thin portions of the upper leg portions 5 on the side of the connecting portions 7 of these coil-shaped fastener elements 2 are sewed with sewing yarn 15 as fixing yarn 14, so as to fix the core thread 28 by multi-thread chain stitches, for example, of two-needle three-yarn as shown in FIG. 3.

The core thread 28 is sewed with two needle yarns 17 of multi-thread chain stitches such that its side edge is protruded toward the coupling heads 4 beyond the protruded portions 10, especially between each pair of adjacent coil-shaped fastener elements 2, so that the core thread 28 can make contact with the coupling heads 4 of mating coil-shaped fastener elements 2. One of the two needle yarns 17 near the coupling heads 4 holds the coil-shaped fastener elements 2 at higher positions of top surfaces of the upper leg portions 5 at the time of sewing. Because that sewing position is near the stepped portions 8, the needle yarn 17 then slides down along the stepped portions 8, so that it comes to be located at lower positions of the top surface of the upper leg portions 5. Consequently, the needle yarn 17 is curved as shown in FIG. 3 so that a force trying to restore to its original shape acts to normally urge the core thread 28 toward the coupling heads 4. Meanwhile, a looper yarn 16 is disposed at lower positions of the top surfaces of the upper leg portions 5, so that it is prevented from being worn by contact of a slider 32 when the slider 32 is slid.

Figure 5:
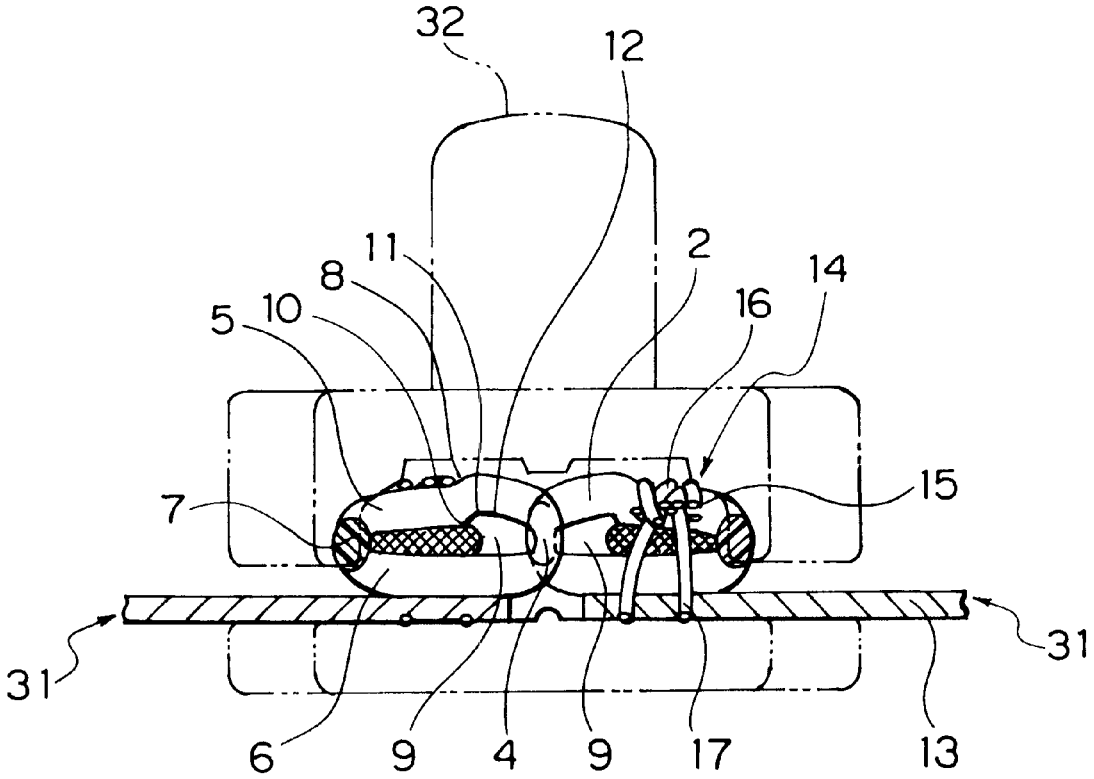
FIG. 5 is a lateral sectional view showing a state before the same fastener stringers couple with each other.
Figure 6:
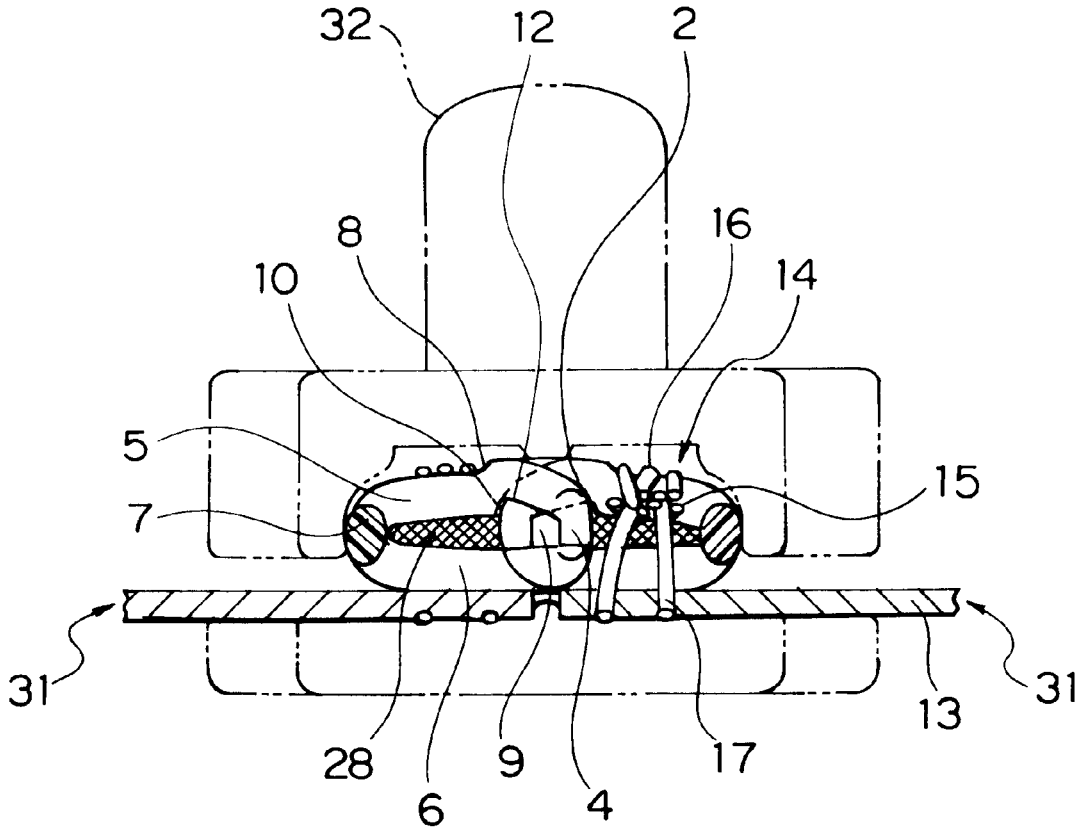
FIG. 6 is a lateral sectional view showing a state after the same fastener stringers are coupled with each other.
Figure 7:
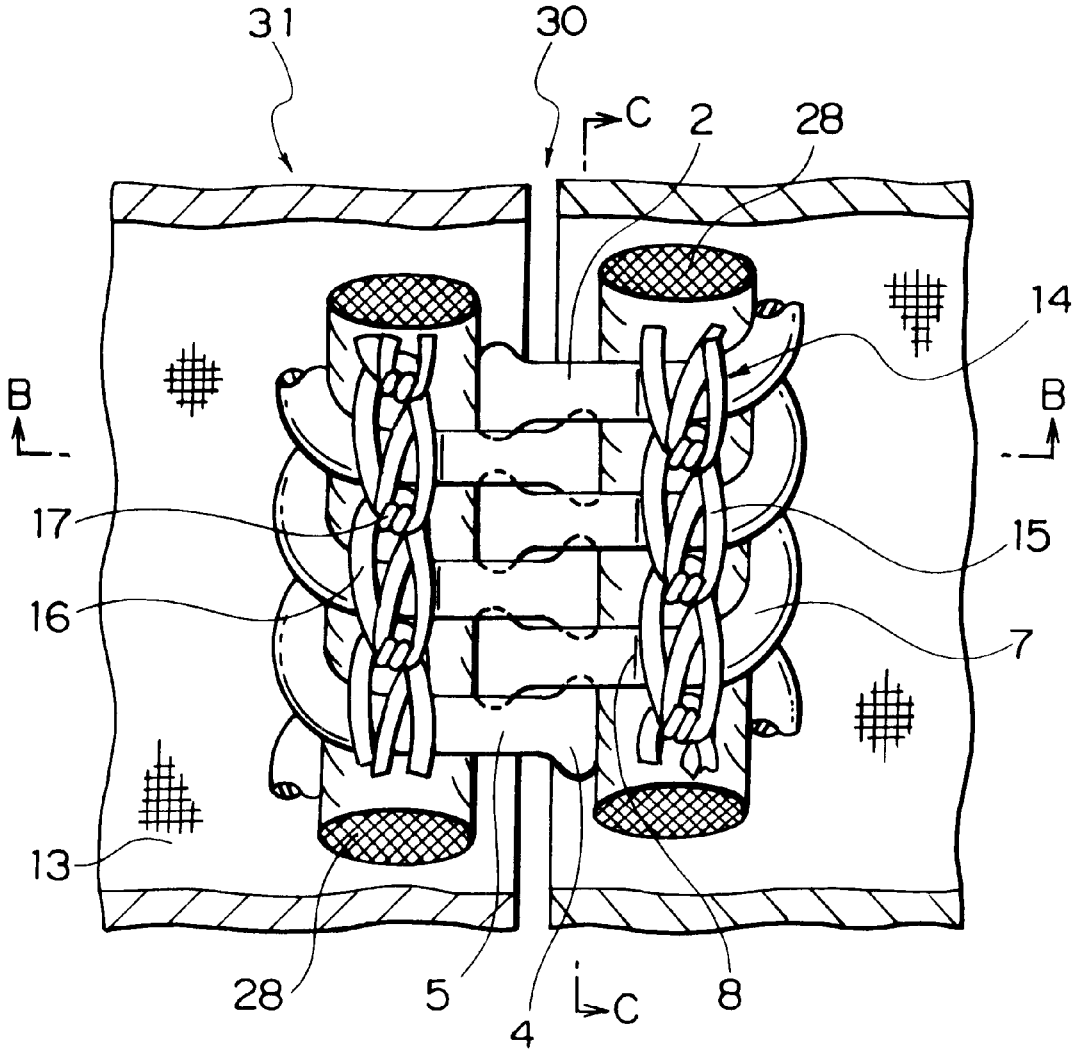
FIG. 7 is a front view of a fastener chain showing a state in which the same fastener stringers are coupled with each other.

A fastener chain 30 as shown in FIG. 7 is constructed with fastener stringers 31 formed in the above manner by making the coupling heads 4 of the right and left fastener stringers 31 couple each other by means of the slider 32, as shown in FIGS. 5, 6. Now, the coupling operation will be described. Because a height dimension of on outer side of the coupling space 9, that is, the portion near the coupling head 4, is smaller than a thickness of the coupling head 4 of a mating coil-shaped fastener element 2, which is to be inserted into the coupling space 9, the coupling head 4 cannot enter the coupling space 9 at the outer side thereof sufficiently, so that the coupling head 4 is introduced to an inner side of the coupling space 9, that is, to near the core thread 28.

Figure 8:
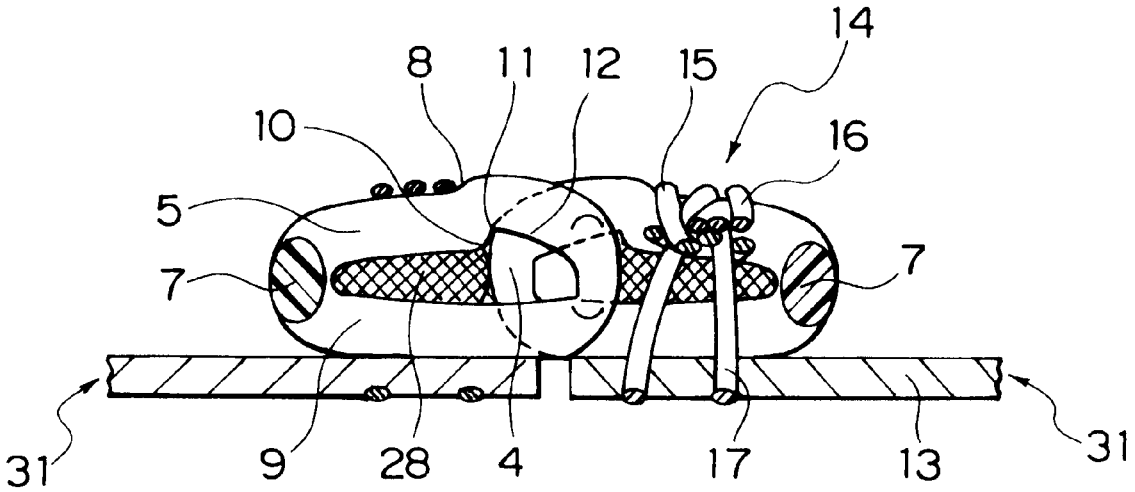
FIG. 8 is a sectional view taken along the line B—B of FIG. 7 showing the same fastener chain.
Figure 9:
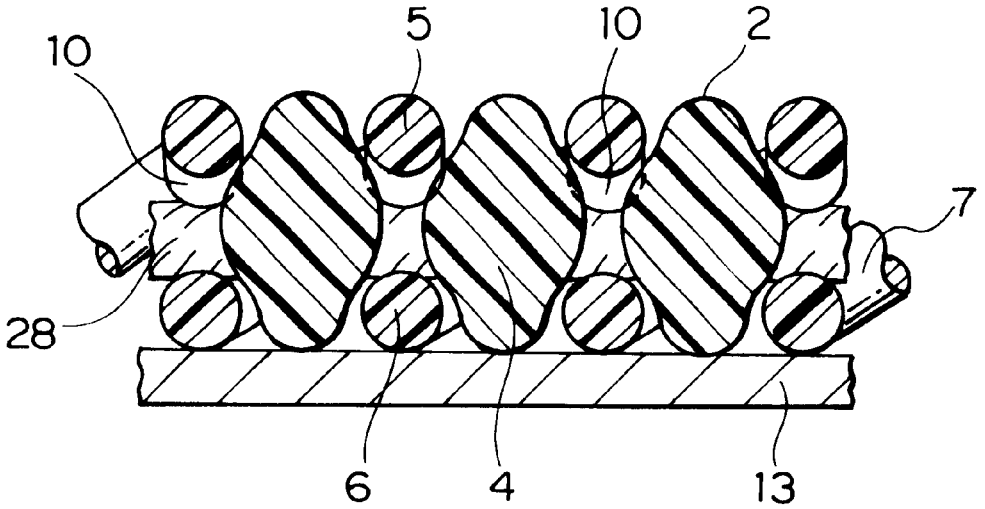
FIG. 9 is a sectional view taken along the line C—C of FIG. 7 showing the same fastener chain (representation of sewing yarn is omitted).

As shown in FIGS. 8, 9, the coupling head 4 of the coil-shaped fastener element 2 continues to be inserted until its upper side face comes to contact with the protruded portion 10 formed on the upper leg portion 5, so that a further invasion thereof is prevented. At this time, the coupling head 4 is inserted smoothly along the slope portion 12 formed in the back of the upper leg portion 5 and expanded as it goes inward, so that the coupling operation can be carried out quickly. As a result, the sliding operation of the slider 32 can be carried out smoothly. As shown in FIG. 8, before the outer side face of the coupling head 4 comes to contact with the protruded portion 10, the coupling head 4 makes contact with the side edge of the core thread 28 so as to relax an impact that occurs when the coupling head 4 collides with the protruded portion 10. Further, the coupling head 4 which is in contact with the core thread 28 is pushed back by a repellent force possessed by the core thread 28. Consequently, a force trying to make the coupling head 4 insert deeper into the coupling space 9 is balanced with a force trying to push back the coupling head 4 out of the coupling space 9. As a result, the right and left coil-shaped fastener elements 2 couple each other in a stabilized state, so that the right and left fastener stringers 31 are joined with each other.

The coil-shaped fastener element 2 may be sewed directly to the fastener tape 13 using the sewing yarn 15 of multi-thread chain stitches as the fixing yarn 14 without using the core thread 28. That is, when no linear fastener elements 1 of a small size is used, no influence is made to the coupling operation of the coupling head 4 and sliding operation of the slider 32, even if the core thread 28 is not used. Further, for the multi-thread chain stitches, one-needle two-yarn type may be used or single chain stitches may be used in which a single needle yarn is used.

The linear slide fastener according to a second embodiment shown in FIGS. 10, 11 is comprised of zigzag-shaped fastener elements 3, each of which includes a coupling head 4 bulging to both sides in an arrangement direction of respective zigzag-shaped fastener elements 3, upper and lower leg portions 5, 6 extending in parallel in a direction perpendicular to the aforementioned arrangement direction, from a top end and a bottom end of the coupling head 4 respectively, and a connecting portion 7 for connecting the respective upper leg portions 5 or the respective lower leg portions 6 of adjacent zigzag-shaped fastener elements 3. Then, a portion of the fastener element 3 on a side of the coupling head 4 is formed to be thick and a portion of the fastener element 3 on a side of the connecting portion 7 is formed to be thin so as to form a stepped portion 8 for providing a step in a center of a top surface of the upper leg portion 5. A coupling space 9, which is surrounded by the upper leg portion 5 and lower leg portion 6, is provided inside of the coupling head 4. Further, a protruded portion 10 protruded into the coupling space 9 is provided in a back of the stepped portion 8 of the upper leg portion 5. Then, a slope portion 12 is formed such that the coupling space 9 increases gradually from an inside of an upper portion of the coupling head 4 to a base portion 11 of the protruded portion 10.

The zigzag-shaped fastener elements 3 are mounted on a side edge of the fastener tape 13. The core thread 28 is disposed between the upper leg portions 5 and lower leg portions 6 at a section from the stepped portions 8 provided in the upper leg portions 5 to the connecting portions 7. The thin portions of the connecting portions 7 of the upper leg portions 5 of the zigzag-shaped elements 3 are sewed to the fastener tape 13 with sewing yarn 15 of multi-thread chain stitches as fixing yarn 14, for example, of two-needle three-yarn type as shown in FIGS. 10, 11.

The core thread 28 is sewed with two needle yarns 17 of multi-thread chain stitches such that its side edge is protruded toward the coupling head 4 beyond the protruded portion 10 between each pair of adjacent zigzag-shaped fastener elements 3, so that the core thread 28 can make contact with the coupling heads 4 of mating zigzag shaped fastener elements 3. One of the two needle yarns 17 near the coupling heads 4 hold the zigzag shaped fastener elements 3 at higher positions of top surfaces of the upper leg portions 5 at the time of sewing. Because that sewing position is near the stepped portions 8, the needle yarn 17 slides down along the stepped portions 8 so that it is located at lower positions of the top surfaces of the upper leg portions 5. Consequently, the needle yarn 17 is curved, so that a force trying to restore to its original shape acts to normally urge the core thread 28 toward the coupling head 4. Meanwhile, a looper yarn 16 is disposed at lower positions of the top surfaces of the upper leg portions 5, so that it is prevented from being worn by contact of a slider when the slider is slid.

A fastener chain is constructed with the fastener stringers 31 formed in the above manner by making the coupling heads 4 of the right and left fastener stringers 31 couple each other by means of a slider 32. Because the coupling operation is the same as the aforementioned first embodiment, a description thereof is omitted. Meanwhile, the zigzag shaped fastener elements 3 may also be sewed using the sewing yarn 15 of the multi-thread chain stitches as the fixing yarn 14 without using the core thread 28 such that a side edge portion of the fastener tape 13 is sandwiched between the upper leg portions 5 and the lower leg portions 6 near the connecting portions 7.

Figure 12:
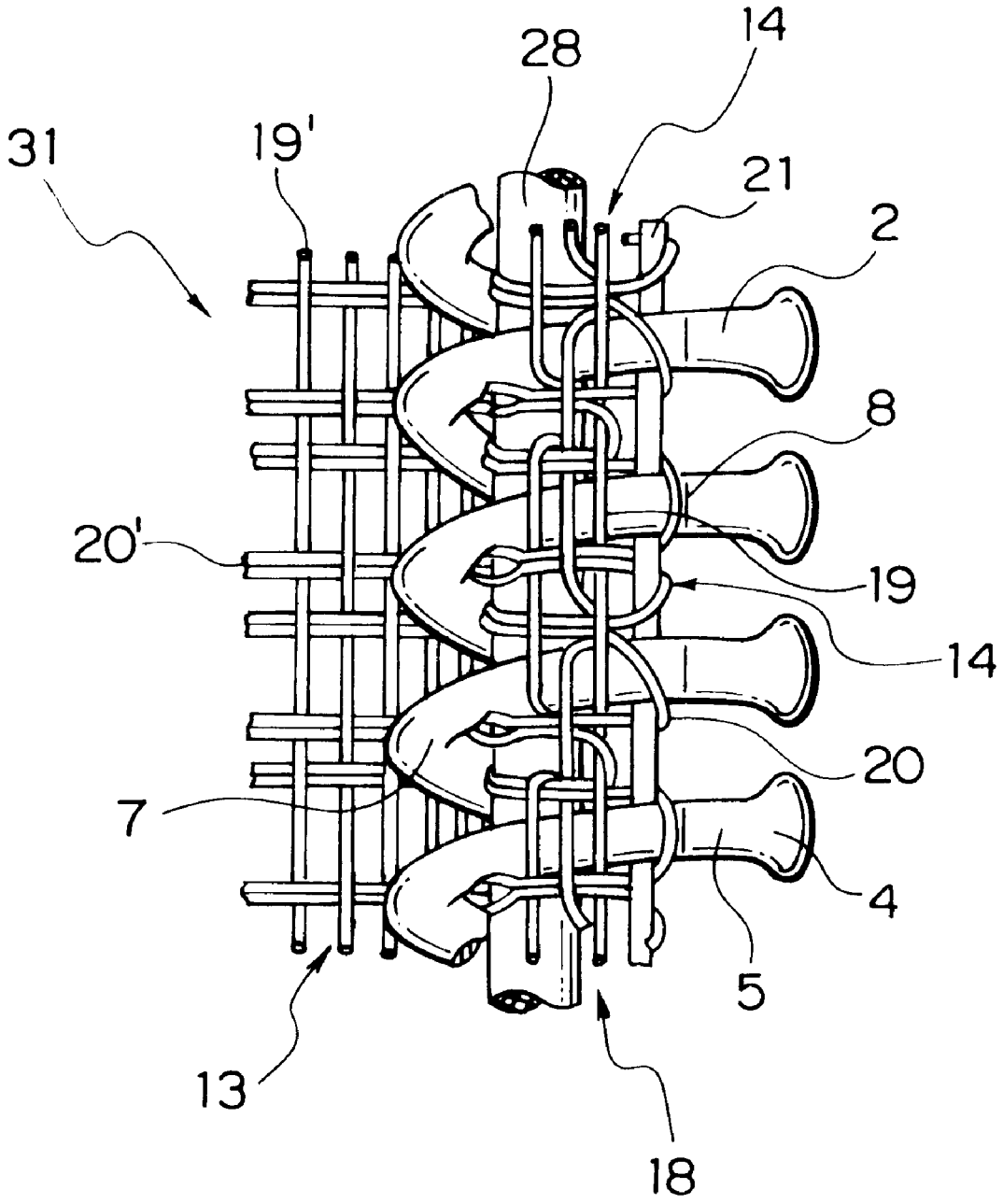
FIG. 12 is a front view of a fastener stringer in which the coil-shaped fastener element is woven.

The coil-shaped fastener elements 2 of a third embodiment shown in FIG. 12 has the same structure as the coil-shaped fastener elements 2 of the first embodiment. A portion of the fastener element 2 on a side of the coupling head 4 is formed to be thick by providing a stepped portion 8 in a center of a top surface of the upper leg portion 5 and a portion of the fastener element 2 on a side of the connecting portion 7 is formed to be thin. A protruded portion 10 protruded into a coupling space 9 is provided in a back of the stepped portion 8 provided in the upper leg portion 5 and a slope portion 12 is provided such that the coupling space 9 expands gradually from an inside of an upper portion of the coupling head 4 to a base portion 11 of the protruded portion 10.

At the same time when the fastener tape 13 is woven, the coil-shaped fastener elements 2 are woven into a side edge of the fastener tape 13 so as to produce a fastener stringer 31. This fastener stringer 31 is produced by inserting a core thread 28 and core yarn 21 between the upper leg portions 5 and lower leg portions 6 of the coil-shaped fastener elements 2 and then disposing several warp yarns 19 and weft yarns 20, which are fixing yarns 14 and weaving yarns 18, on the coil-shaped fastener elements 2 through the core thread 28 and core yarn 21, in such a manner that they are tangled with foundation warp yarns 19' and foundation weft yarns 20' of double pick at the coiled fastener elements 2. Consequently, the coil-shaped fastener elements 2 are woven into the fastener tape 13. Further, the core thread 28 and core yarn 21 may be protruded toward the coupling heads 4 by adjusting a size of the core thread 28 and core yarn 21 to be inserted through the coil- shaped fastener elements 2. Therefore, the weaving yarns 18 of the warp yarns 19 and weft yarns 20 as the fixing yarns 14 can be woven so as to protrude toward the coupling heads 4 beyond the protruded portions 10 between the linear fastener elements 1.

Figure 13:
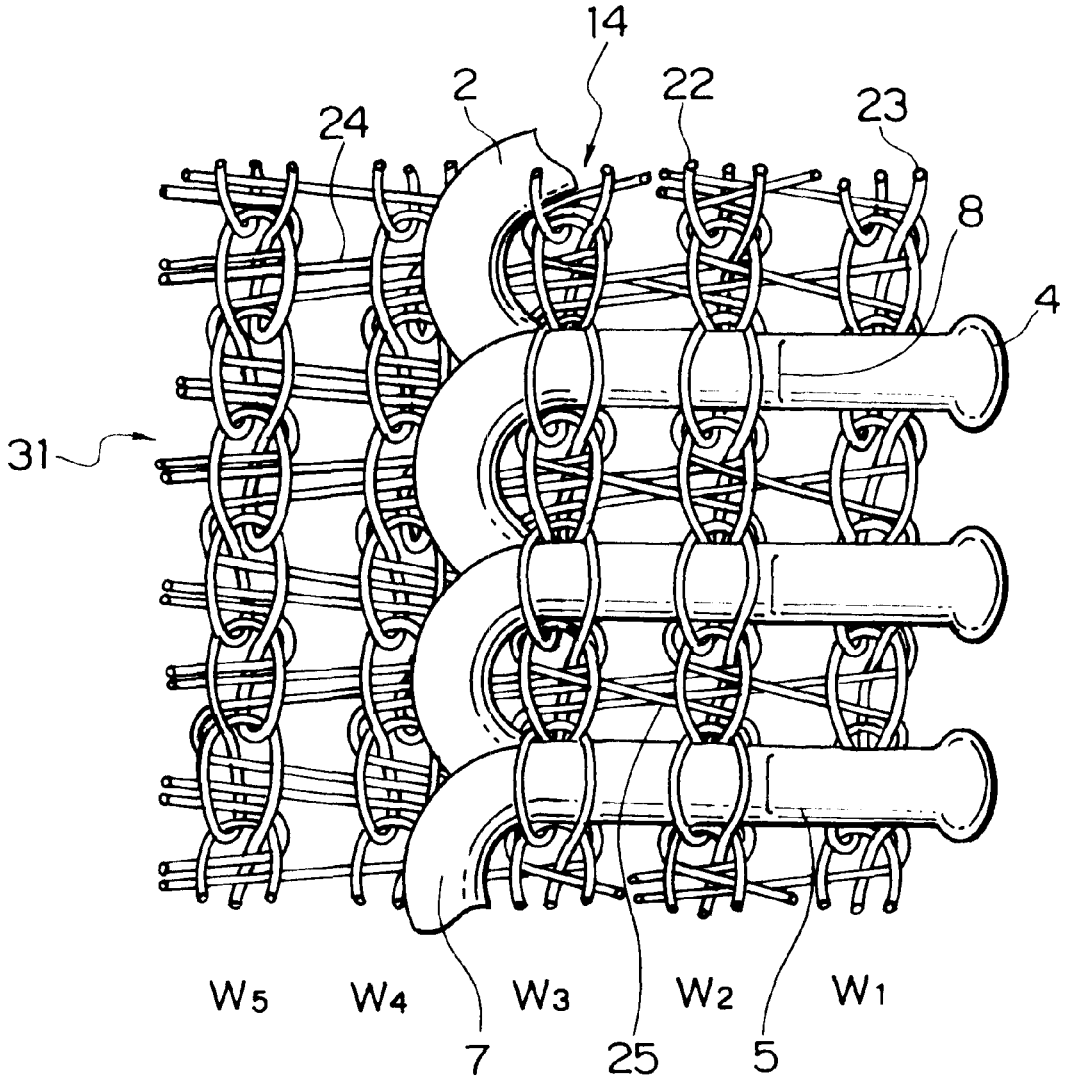
FIG. 13 is a front view of a fastener stringer knitted with the coil-shaped fastener elements.
Figure 14:
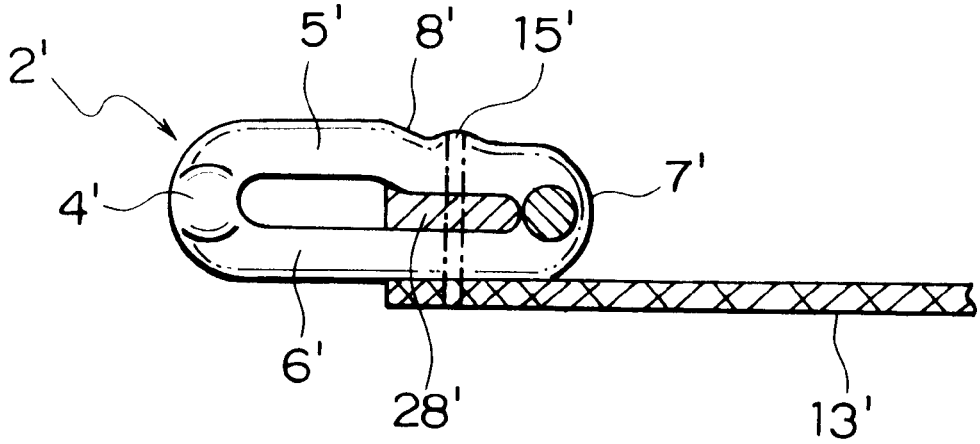
FIG. 14 PRIOR ART
FIG. 14 is a lateral sectional view of a fastener stringer in which a well known coil-shaped fastener elements are welded by ultrasonic heating.
Figure 15:
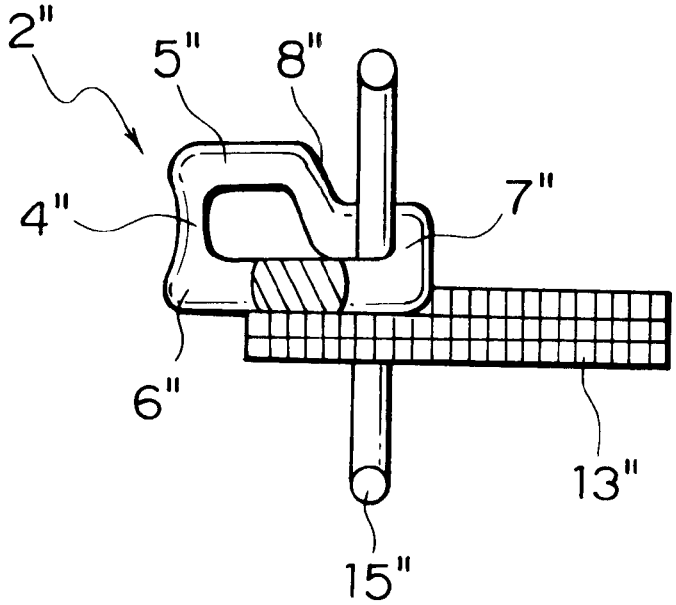
FIG. 15 PRIOR ART
FIG. 15 is a lateral sectional view of a fastener stringer showing a process in which another well known coil-shaped fastener elements are sewed.

Coil-shaped fastener elements 2 of the fourth embodiment shown in FIG. 13 have the same structure as the coil-shaped fastener elements 2 of the first embodiment. By providing a stepped portion 8 in a center of a top surface of the upper leg portion 5, a portion of the fastener element 2 on a side of the coupling head 4 is formed to be thick and a portion of the fastener element 2 on a side of the connecting portion 7 is formed to be thin. Then, a protruded portion protruded into a coupling space is provided in a back of the stepped portion 8 provided in the upper leg portion 5 and the slope portion is formed on a side of the coupling head 4 inside of the upper leg portion 5. In this case, there is no core thread 28 between the upper leg portion 5 and lower leg portion 6.

The fastener stringer 31 is formed by knitting the coil-shaped fastener elements 2 into a warp knitting structure using warp knitting yarns 22 as fixing yarns 14. That is, in all wales of the warp knitting structure, a chain knitting yarn 23 of 1-0/0-1 and a weft insertion yarn 24 of 0-0/3-3 are disposed such that they are tangled with each other. In the wales $W_1$–$W_3$, a weft insertion yarn 25 of 2-2/0-0 is disposed so as to intersect the weft insertion yarn 24. To tighten and fix the coil-shaped fastener elements 2, the upper leg portions 5 are captured and tightened by the chain knitting yarn 23 of $W_2$ and $W_3$ at a section from the stepped portion 8 of the upper leg portion 5 to the connecting portion 7.

The warp knitting yarn 22 is not restricted to the aforementioned knitting yarn. It is permissible to dispose a tricot knitting yarn of 1-2/1-0 or two needle stitch yarn of 0-2/2-0 in all wales so as to knit the fastener tape 13. The knitting structure may be modified by adding other yarns or changed arbitrarily.

The linear slide fastener of the present invention has the above described structure, with which the following effects are exerted.

According to the present invention, with providing a stepped portion 8 in an upper leg portion 5 of each of the linear fastener elements 1, a portion of the fastener element 1 on a side of a coupling head 4 is formed to be thick while a portion thereof on a side of a connecting portion 7 is formed to be thin; a protruded portion 10 protruded into a coupling space 9 between the upper leg portion 5 and the lower leg portion 6 is provided on an inner face of the upper leg portion 5; a slope portion 12 is provided such that the coupling space 9 is expanded gradually from an inside of the coupling head 4 to a base portion 11 of the protruded portion 10. Therefore, the coupling heads 4 can be inserted into the coupling spaces 9 smoothly along the slope portions 10, so that the coupling operation can be carried out smoothly and the sliding operation of the slider 32 can be carried out lightly. Further, an excessive insertion of the coupling heads 4 can be prevented so as to maintain a stabilized coupling state.

Because the connecting portions 7 of the linear fastener elements 1 are formed to be thin and these portions are fixed to the fastener tape 13 with the fixing yarn 14, the linear fastener elements 1 can be fixed to the fastener tape 13 firmly in a stabilized state. Further, the fixing yarns 14 are prevented from being worn by the sliding of the slider 32 to bear a long term use thereof.

According to the present invention, the linear fastener elements 1 are sewed to the fastener tape 13 using the sewing yarn 15 as the fixing yarn 14 or woven thereinto using the weaving yarn 18 as the fixing yarn 14 or knitted thereinto using the warp knitting yarn 22 as the fixing yarn 14. Thus, a sewing-type linear slide fastener or weaving-type linear slide fastener or knitting-type linear slide fastener having the feature structure of the present invention can be produced easily.

Furthermore, according to the present invention, the linear fastener elements 1 are in a form of coil-shaped fastener elements 2 produced by winding a monofilament in a coil-shaped shape or in the form of zigzag shaped fastener elements 3 by bending a monofilament in a zigzag shape. Thus, the coil-shaped slide fastener or zigzag shaped slide fastener having the feature structure of the present invention can be produced easily.

Still further, according to the present invention, a side edge of a core thread 28 inserted between the upper leg portions 5 and lower leg portion 6 of the linear fastener elements 1 is protruded toward the coupling heads 4 beyond the protrude d portions 10. Thus, even if a push-up force is applied to the fastener elements I in a coupling state, breaking of the coupling can be prevented. Further, when the coupling heads 4 couple each other, the core thread 28 makes contact with the coupling heads 4 of the mating linear fastener elements 1, so that the core thread 28 serves as an appropriate cushion. Consequently, the sliding operation of the slide fastener can be carried out flexibly and lightly.

Still further, according to the present invention, a needle yarn 17 of multi-thread chain stitches urges the core thread 28 such that the side edge of the core thread 28 is always protruded. Thus, the core thread 28 is capable of functioning as an effective cushion in a stabilized state.

Still further, according to the present invention, a side edge of the fixing yarn 14 disposed between adjacent ones of the linear fastener elements 1 is protruded toward the coupling heads 4 beyond the protruded portions 10. Thus, when the coupling heads 4 couple each other, the fixing yarn 14 act as an appropriate cushion so as to enable a flexible and light sliding operation of the slider 32. As described above, the present invention exerts very remarkable effects.

What is claimed is:

1. A linear slide fastener, wherein linear fastener elements are formed of thermoplastic resin monofilament; with providing a stepped portion in an upper leg portion of each of the linear fastener elements, a portion of the fastener element on a side of a coupling head is formed to be thick while a portion thereof on a side of a connecting portion is formed to be thin; a protruded portion protruded into a coupling space between the upper leg portion and a lower leg portion of each of the linear fastener elements is internally provided on an inner face of the upper leg portion; a slope portion is provided such that the coupling space is expanded gradually from an inside of the coupling head to a base portion of the protruded portion; and the fastener elements are fixed to a fastener tape at the connecting portions with fixing yarn.

2. A linear slide fastener according to claim 1, wherein the linear fastener elements are sewed to a side edge of the fastener tape using a sewing yarn as the fixing yarn for fixing the linear fastener elements.

3. A linear slide fastener according to claim 1, wherein the linear fastener elements are woven into a side edge of the fastener tape using a weaving yarn as the fixing yarn for fixing the linear fastener elements.

4. A linear slide fastener according to claim 1, wherein the linear fastener elements are knitted into a side edge of the fastener tape using a warp knitting yarn as the fixing yarn for fixing the linear fastener elements.

5. A linear slide fastener according to claim 1, wherein the linear fastener elements are in a form of coil-shaped fastener elements produced by winding a monofilament in a coil-shaped shape.

6. A linear slide fastener according to claim 1, wherein the linear fastener elements are in a form of zigzag shaped fastener elements produced by bending a monofilament in a zigzag shape.

7. A linear slide fastener according to claim 1, wherein a side edge of a core thread inserted between the upper leg portions and lower leg portions is protruded toward the coupling heads beyond the protruded portions.

8. A linear slide fastener according to claim 7, wherein a needle yarn of multi-thread chain stitches urges the core thread such that the side edge of the core thread is always protruded.

9. A linear slide fastener according to claim 1, wherein a side edge of the fixing yarn disposed between adjacent ones of the linear fastener elements is protruded toward the coupling heads beyond the protruded portions.

* * * * *